US008394881B2

(12) United States Patent
Yamada et al.

(10) Patent No.: US 8,394,881 B2
(45) Date of Patent: Mar. 12, 2013

(54) GOLF BALL

(75) Inventors: Eisuke Yamada, Nagoya (JP); Toshiyuki Tarao, Kobe (JP)

(73) Assignees: Eisuke Yamada, Nagoya (JP); SRI Sports Limited, Kobe (JP)

( * ) Notice: Subject to any disclaimer, the term of this patent is extended or adjusted under 35 U.S.C. 154(b) by 698 days.

(21) Appl. No.: 12/363,368

(22) Filed: Jan. 30, 2009

(65) Prior Publication Data

US 2009/0197706 A1 Aug. 6, 2009

(30) Foreign Application Priority Data

Jan. 31, 2008 (JP) ..... 2008-021852

(51) Int. Cl.

| | |
|---|---|
| ***A63B 37/12*** | (2006.01) |
| ***A63B 37/00*** | (2006.01) |
| ***C08K 9/10*** | (2006.01) |
| ***C08K 3/34*** | (2006.01) |
| ***C08F 292/00*** | (2006.01) |

(52) U.S. Cl. ..... 524/447; 524/445; 524/449; 524/789; 524/790; 524/791; 473/378; 473/385

(58) Field of Classification Search ..... None
See application file for complete search history.

(56) References Cited

U.S. PATENT DOCUMENTS

| | | | | |
|---|---|---|---|---|
| 5,306,760 | A | 4/1994 | Sullivan | |
| 5,692,974 | A | 12/1997 | Wu et al. | |
| 5,851,245 | A | 12/1998 | Moriyama et al. | |
| 6,051,643 | A | 4/2000 | Hasegawa et al. | |
| 6,688,992 | B2 | 2/2004 | Takemura et al. | |
| 6,793,592 | B2 | 9/2004 | Sullivan et al. | |
| 6,794,447 | B1 | 9/2004 | Kim et al. | |
| 7,066,836 | B2 | 6/2006 | Hayashi | |
| 7,332,533 | B2 | 2/2008 | Kim et al. | |
| 7,943,689 | B2 | 5/2011 | Shiga et al. | |
| 2002/0045501 | A1 | 4/2002 | Takemura et al. | |
| 2004/0048129 | A1* | 3/2004 | Taft et al. | 429/33 |
| 2004/0092336 | A1 | 5/2004 | Kim et al. | |
| 2005/0059756 | A1* | 3/2005 | Kim et al. | 523/220 |
| 2005/0228140 | A1* | 10/2005 | Rajagopalan et al. | 525/221 |
| 2006/0009308 | A1 | 1/2006 | Isogawa et al. | |
| 2006/0009585 | A1 | 1/2006 | Fujisawa et al. | |
| 2006/0128867 | A1* | 6/2006 | Marx et al. | 524/445 |

(Continued)

FOREIGN PATENT DOCUMENTS

| | | | |
|---|---|---|---|
| JP | 8-302068 | A | 11/1996 |
| JP | 9-124836 | A | 5/1997 |

(Continued)

OTHER PUBLICATIONS

Choi et al., "Synthesis of chain-extended organifier and properties of polyurethane/clay nanocomposites", Polymer, vol. 45, 2004, pp. 6045-6057.

(Continued)

*Primary Examiner* — David Buttner
(74) *Attorney, Agent, or Firm* — Birch, Stewart, Kolasch & Birch, LLP

(57) ABSTRACT

To provide a golf ball with excellent abrasion-resistance and resilience.

A golf ball of the present invention comprises: a core; and a cover covering the core, wherein the cover is formed of a cover composition containing a (meth)acrylic polymer-modified silicate and a resin component.

6 Claims, 1 Drawing Sheet

U.S. PATENT DOCUMENTS

| | | | | |
|---|---|---|---|---|
| 2006/0137797 | A1 | 6/2006 | Galimberti et al. | |
| 2006/0235128 | A1 * | 10/2006 | Wang et al. | 524/445 |
| 2007/0276109 | A1 | 11/2007 | Sawaguchi et al. | |
| 2008/0214326 | A1 | 9/2008 | Kim et al. | |
| 2008/0293518 | A1 | 11/2008 | Shiga et al. | |
| 2009/0197706 | A1 | 8/2009 | Yamada et al. | |
| 2010/0331115 | A1 | 12/2010 | Shiga et al. | |

FOREIGN PATENT DOCUMENTS

| | | | |
|---|---|---|---|
| JP | 9-183910 | A | 7/1997 |
| JP | 10-168305 | A | 6/1998 |
| JP | 2002-136618 | A | 5/2002 |
| JP | 2002-539905 | A | 11/2002 |
| JP | 2003-511116 | A | 3/2003 |
| JP | 2004-504900 | A | 2/2004 |
| JP | 2005-28153 | A | 2/2005 |
| JP | 2005-106859 | A | 4/2005 |
| JP | 2006-43447 | A | 2/2006 |
| JP | 2006-95286 | A | 4/2006 |
| JP | 2006-346014 | A | 12/2006 |
| JP | 2006-346015 | A | 12/2006 |
| JP | 2008-289674 | A | 12/2008 |
| KR | 10-2005-0112693 | A | 12/2005 |
| WO | WO 00/57962 | A1 | 10/2000 |
| WO | WO 01/24888 | A1 | 4/2001 |

OTHER PUBLICATIONS

English language of a Japanese Office Action for Application No. 2009-154269 dated Jul. 26, 2011.

Inagaki et al., "Synthesis and characterization of highly ordered mesoporous material; FSM-16, from a layered polysilicate", Studies in Surface Science and Catalysis, vol. 84, 1994, pp. 125-132.

Inagaki et al., "Synthesis of New Mesoporous Material by Folding Silicate Sheets", Science and Technology in Catalysis, 1994, pp. 143-148.

Japanese Office Action for Application No. 2007-138441 dated Apr. 28, 2009, with English translation.

Laviosa Chimica Mineraria S.p.A., "Nanoclay for nanocomposites", DELLITE® 67G, 1 page.

Nanocor, "Nylon Nanocomposites Using Nanomer® I.24TL Nanoclay", Lit N-609 (Oct. 2004), 2 pages.

Shah et al., "Nanocomposites from poly(ethylene-co-methacrylic acid) ionomers: effect of surfactant structure on morphology and properties", Polymer, vol. 46, 2005, pp. 2646-2662.

U.S. Office Action for U.S. Appl. No. 12/153,682 dated Sep. 17, 2010.

U.S. Office Action for U.S. Appl. No. 12/422,392 dated Aug. 10, 2011.

U.S. Office Action for U.S. Appl. No. 12/422,505 dated Aug. 10, 2011.

Kirk-Othmer, Concise Encyclopedia of Chemical Technology, 1990, pp. 1053, 1058.

Mayer et al., "Characterizing Radiation-Aged Polysiloxane-Silica Composites: Identifying Changes in Network Topology via 1H NMR", Chemical Engineering Science, 2008, pp. 1-15.

U.S. Office Action for U.S. Appl. No. 13/478,653 dated Sep. 20, 2012.

Japanese Office Action with the English translation dated Mar. 21, 2012, for Application No. 2008-021852.

Japanese Office Action with the English translation dated Mar. 21, 2012, for Application No. 2008-110385.

Japanese Office Action with the English translation dated Jul. 3, 2012, for Application No. 2009-090516.

* cited by examiner

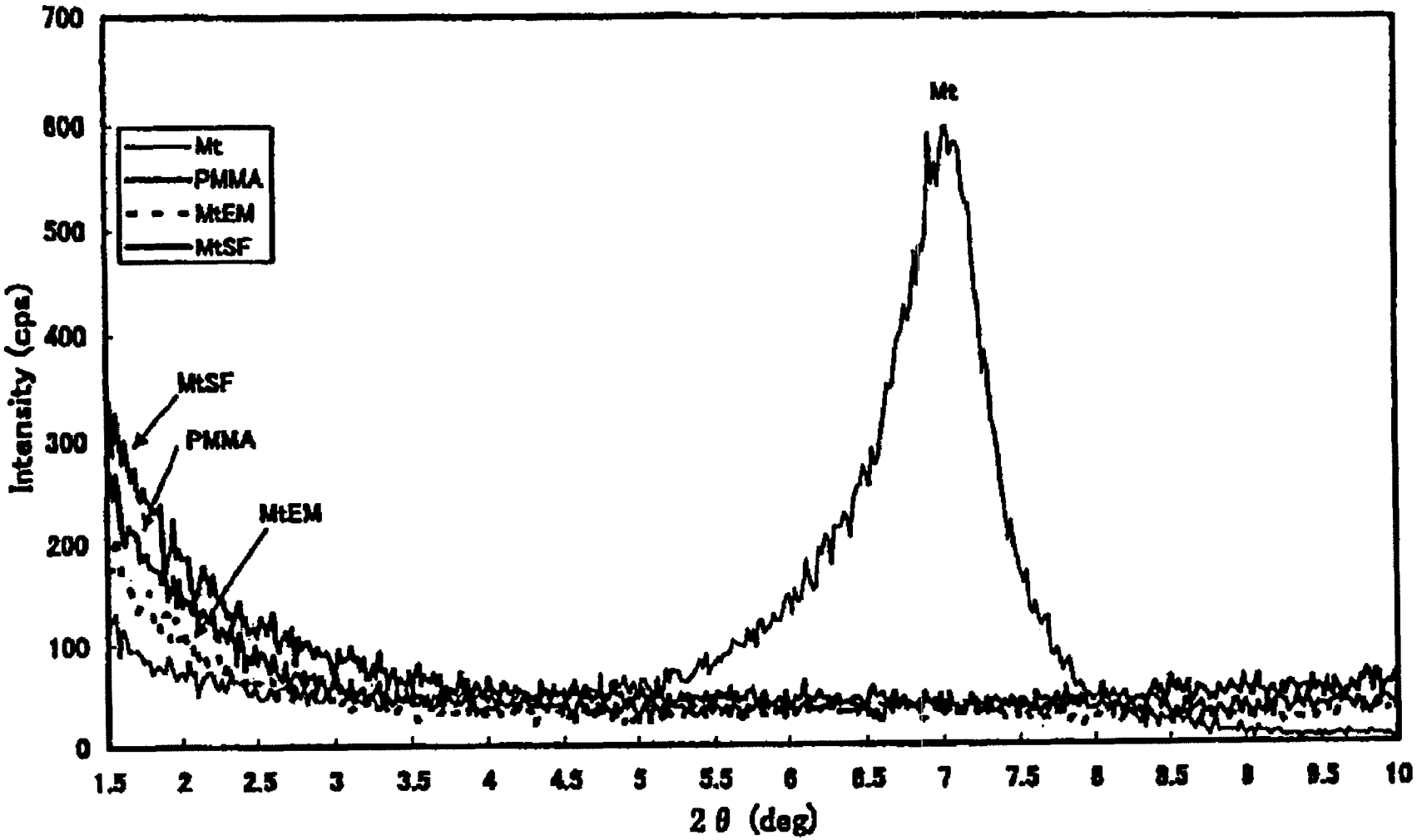
Mt
PMMA
MtEM
MtSF
Mt
PMMA
MtEM
MtSF
Intensity (cps)
2θ (deg)
700
600
500
400
300
200
100
0
1.5
2
2.5
3
3.5
4
4.5
5
5.5
6
6.5
7
7.5
8
8.5
9
9.5
10

GOLF BALL

FIELD OF THE INVENTION

The present invention relates to a golf ball that has excellent abrasion-resistance and repulsion.

DESCRIPTION OF THE RELATED ART

Ionomer resins and polyurethane are used as a resin component of a cover of a golf ball. Although covers that contain ionomer resins are widely used because of their excellent resilience, it is indicated that they have inferior abrasion-resistance when their rigidity or hardness deteriorates. On the other hand, polyurethane is used as a resin component of a cover since the usage of polyurethane improves the abrasion-resistance compared to ionomer resins. However, a golf ball with a cover that contains a thermoplastic polyurethane does not have sufficient repulsion.

There are proposals to improve characteristics of a cover by blending fillers made of organic short fibers, glass, metal, or clay minerals into a resin component of a cover. For example, Japanese Publication No. 2004-504900 A discloses a golf ball comprising a nanocomposite material, wherein the nanocomposite material comprises a polymer having a structure in which particles of inorganic material are reacted and substantially evenly dispersed, wherein each particle has a largest dimension that is about one micron or less and that is at least an order of magnitude greater than such particle's smallest dimension. Further, Japanese Patent Publication No. 2006-43447 A discloses a golf ball comprising a core, and an outer layer portion surrounding the core, wherein the outer layer portion is made of a resin material with a resin matrix that contains a cation treated layered silicate therein.

SUMMARY OF THE INVENTION

However, with the golf balls described in the above patent references, the dispersibility of the inorganic material into the resin component is not sufficient, leaving potential for improving abrasion-resistance and resilience of a golf ball.

The present invention has been made in view of the above problems and an objective of the present invention is to provide a golf ball having excellent abrasion-resistance and repulsion.

The golf ball that has solved the above problem comprises: a core; and a cover covering the core, wherein the cover is formed from a cover composition containing a (meth)acrylic polymer modified silicate and a resin component.

If a normally hydrophilic unmodified silicate is used without any treatments, the dispersibility of the silicate into the resin component would possibly be insufficient. Modifying the silicate with a (meth)acrylic polymer allows the silicate to be stably dispersed into the resin component via the (meth) acrylic polymer. Thus, a less amount of the (meth)acrylic polymer modified silicate improves the elasticity of the cover composition, than that of an unmodified silicate which is conventionally used, and the abrasion-resistance and repulsion can be also improved.

As the (meth)acrylic polymer-modified silicate, typically preferred is the (meth)acrylic polymer-modified silicate where a silicate having layered structure is enveloped by a (meth)acrylic polymer. The (meth)acrylic polymer-modified silicate is preferably such that the layered silicate has an interlayer spacing of at least 6 nm measured by X-ray diffraction, or a X-ray diffraction peak attributed to the layered silicate is not detected.

Further, as the (meth)acrylic polymer-modified silicate, preferred is the (meth)acrylic polymer-modified silicate where a silicate having a porous structure is enveloped by a (meth)acrylic polymer.

The cover preferably contains the (meth)acrylic polymer-modified silicate in an amount of 0.01 part to 20 parts by mass with respect to 100 parts by mass of the resin component.

The resin component preferably comprises a thermoplastic polyurethane or an ionomer resin as the resin component.

The cover composition preferably has a slab hardness of from 75 to 98 in Shore A hardness.

According to the present invention, a golf ball having excellent abrasion-resistance and repulsion is achieved.

BRIEF DESCRIPTION OF THE DRAWINGS

FIG. 1 is an X-ray diffraction pattern of MtSF ((meth) acrylic polymer modified montmorillonite).

BEST MODE FOR CARRYING OUT THE INVENTION

A golf ball of the present invention comprises a core, and a cover covering the core, wherein the cover is formed from a cover composition containing a (meth)acrylic polymer-modified silicate and a resin component.

First, the (meth)acrylic polymer-modified silicate used in the cover composition will be explained. The (meth)acrylic polymer-modified silicate is a silicate which is enveloped by the (meth)acrylic polymer or a silicate which is dispersed into the (meth)acrylic polymer.

A silicate used as a material for the (meth)acrylic polymer-modified silicate (hereinafter sometimes referred to as "unmodified silicate") is not limited. Examples of the unmodified silicate are: a phyllosilicate such as montmorillonite; a nesosilicate such as sillimanite; a sorosilicate such as gehlenite; a cyclosilicate such as cordierite; an inosilicate such as ferrosilite; a tectosilicate such as zeolite; and a porous silica. These unmodified silicates can be used individually or as a combination of two or more thereof. Among these, the layered silicate that have layered structures such as the phyllosilicate or the porous silicate that have porous structures such as the tectosilicate or the porous silica are preferred as the unmodified silicate.

Hereinafter, when the layered silicate having the layered structure is used as the unmodified silicate, the obtained (meth)acrylic polymer-modified silicate is sometimes referred to as "(meth)acrylic polymer-modified layered silicate". Moreover, when the porous silicate having the porous structure is used as the unmodified silicate, the obtained (meth)acrylic polymer modified silicate is sometimes referred to as "(meth)acrylic polymer-modified porous silicate". The (meth)acrylic polymer-modified layered silicate includes a (meth)acrylic polymer modified silicate where the layered silicate in the (meth)acrylic polymer-modified layered structure is broken up into a single-leaf state, as described later.

The layered silicate is not limited, as long as it is a silicate having a layered structure. Examples of the layered silicate are: a layered silicate of kaolinite group such as kaolinite, dickite, halloysite, chrysotile, lizardite and amesite; a layered silicate of smectite group such as montmorillonite, beidellite, nontronite, saponite, ferrous saponite, hectorite, sauconite and stevensite; a layered silicate of vermiculite group such as dioctahedral vermiculite and trioctahedral vermiculite; a layered silicate of mica group such as muscovite, paragonite, phlogopite, biotite and lepidolite; a layered silicate of brittle mica group such as margarite, clintonite and anandite; a layered silicate of chlorite group such as cookeite, sudoite, clinochlore, chamosite and nimite. Among these, the layered silicate of smectite group such as montmorillonite, beidellite, nontronite, saponite, ferrous saponite, hectorite, sauconite and stevensite are preferred, and especially preferred is montmorillonite.

Specific examples of the layered silicate are: "Kunipia (registered trademark) F", "Kunipia (registered trademark) G" and "Sumecton (registered trademark) SA" available from Kunimine Industries Co., Ltd.; "Dellite (registered trademark) 43B", "Dellite (registered trademark) 67G" and "Dellite (registered trademark) HPS" available from Laviosa Chimica Mineraria S.p.A.

When the above-described layered silicate is used, it is possible to incorporate a large amount of the (meth)acrylic polymer into the interlayer of the layered silicate. This makes it possible for the layered silicate to be covered by large amount of the (meth)acrylic polymer, resulting in a more stable dispersibility of the layered silicate into the resin component.

In the case of using the layered silicate, the layered silicate in the (meth)acrylic polymer-modified silicate is broken up into a single-leaf state. By making the layered silicate enveloped in the (meth)acrylic polymer modified silicate into a single leaf state, the (meth)acrylic polymer-modified silicate can be added in a less amount which is enough to provide the improved effect of the repulsion and abrasion-resistance. In the present invention, the status that the layered silicate in the (meth)acrylic polymer modified silicate being single-leaf state means that either the (meth)acrylic polymer modified silicate has an interlayer spacing of at least 6 nm or more measured by X-ray diffraction, or a X-ray diffraction peak attributed to the layered structure is not detected. The measurement condition of X-ray diffraction is described later.

The porous silicate is not limited, as long as it is a silicate having a porous structure. Examples of the porous silicate are porous silica that has uniform pores; and a zeolite such as chabazite, mordenite, A-type zeolite, X-type zeolite and Y-type zeolite. Especially preferred is a mesoporous silica, generally referred to as "Folded Sheets Mesoporous Materials (FMS)", disclosed in "Studies in Surface Science and Catalysis", 84, p 125-132 (1994) and "Studies in Surface Science and Catalysis", 92, p 143-148 (1995).

Folded Sheets Mesoporous Material is a silica having pores obtained by: mixing and reacting a silicate having a layered structure, such as kenyaite, makatite, illite and kanemite, with an organic compound such as a surfactant to form surfactant micelles in the interlayer of the layered silicate having the layered structure; and removing the surfactant.

A specific example of the porous silicate is "NPM (Nano Porous Material)-14" available from Taiyo Kagaku Co., Ltd.

When the porous silicate is used, it is possible to incorporate a large amount of the (meth)acrylic polymer into the pores of the porous silicate. This makes it possible for the porous silicate to be covered by a large amount of the (meth) acrylic polymer, resulting in a more stable dispersibility of the porous silicate into the resin component.

The (meth)acrylic polymer constituting the (meth)acrylic polymer-modified silicate is not limited, as long as it is obtained by polymerizing a monomer composition containing a (meth)acrylic monomer (hereinafter sometimes referred to simply as "monomer composition").

Examples of the (meth)acrylic monomer are: (meth)acrylic acid; a (meth)acrylic acid ester such as methyl(meth)acrylate, ethyl(meth)acrylate, butyl(meth)acrylate and 2-ethylhexyl (meth)acrylate; a (meth)acrylic acid ester having a hydroxyl group such as 2-hydroxyethyl(meth)acrylate and; a (meth) acrylic acid amide such as N-alkyl-substituted acrylamide and N,N-dimethylaminopropyl(meth)acrylamide. These (meth)acrylic monomer can be used individually or as a combination of two or more thereof. Among these, the (meth) acrylic acid ester having a carbon number from 4 to 20 is preferred. Moreover, methyl(meth)acrylate and ethyl(meth) acrylate are especially preferred.

As the (meth)acrylic monomer, a (meth)acrylic acid ester having a tertiary amino group is preferably used. The (meth) acrylic acid ester having a tertiary amino group can be used individually or as a combination of two or more thereof. As the (meth)acrylic acid ester having a tertiary amino group, those having a carbon number of 4 to 20 are preferred. Moreover, (meth)acrylic acid 2-(dimethylamino)ethyl ester is especially preferred. If the (meth)acrylic acid ester having a tertiary amino group is used, it is possible to obtain a polymer without using a dispersant in an aqueous system. Additionally, the use of the (meth)acrylic acid ester having a tertiary amino group facilitate the single-leaf state of the layered silicate, because the (meth)acrylic acid ester having a tertiary amino group readily incorporates in the interlayer of the layered silicate by the effect of the tertiary amino group.

The (meth)acrylic polymer may contain a monomer component other than the (meth)acrylic monomer to an extent that the effect of the present invention does not deteriorate, but it is more preferable that the (meth)acrylic polymer consists of the (meth)acrylic monomer. Furthermore, the (meth)acrylic polymer may contain a dispersant (surfactant) or a polymerization initiator to an extent that the effect of the present invention does not deteriorate.

A method for manufacturing the (meth)acrylic polymer-modified silicate used in the present invention is explained below.

In a method for manufacturing the (meth)acrylic polymer-modified silicate, without any limitation, the monomer composition is polymerized so that the silicate is enveloped by the (meth)acrylic polymer or the silicate is dispersed into the (meth)acrylic polymer. For example, the (meth)acrylic polymer-modified silicate can be obtained by dispersing the monomer composition and the unmodified silicate into a dispersion medium, and polymerizing the monomer composition in a dispersion. A publicly known polymerization method, such as emulsion polymerization and suspension polymerization, may be used as the polymerization method for manufacturing the (meth)acrylic polymer-modified silicate. Among these methods, emulsion polymerization is preferred.

The dispersion medium, without limitation, includes materials such as water, an organic solvent, liquid carbon dioxide, or carbon dioxide at supercritical state. Among these, from an economic point of view, water is preferred. The amount of the dispersion medium is such that the unmodified silicate is preferably used in an amount of 0.1 parts by mass or more, more preferably 1 part by mass or more, even more preferably 5 parts by more, and is preferably in an mount of 200 parts by mass or less, more preferably 150 parts by mass or less, even more preferably 100 parts by mass or less with respect to 100 parts by mass of the dispersion medium.

A polymerization initiator may be used where necessary. As the polymerization initiator, any polymerization initiator that is generally used for polymerization can be used. Examples of the polymerization initiator are a free radical polymerization initiator and an ionic polymerization initiator. Among these, the free radical initiator is preferred. Examples of the free radical initiators are: an organic peroxide such as potassium peroxydisulfate and benzoyl peroxide and; an azo compound such as azobisisobutyronitrile and 2,2'-Azobis(2-methylbutyronitrile). Among these free radical initiators, the organic peroxide is preferred, and potassium peroxydisulfate is especially preferred.

The polymerization initiator is preferably added in an amount of 0.01 parts by mass or more, and is preferably added in an amount of 20 parts by mass or less, even more preferably 10 parts by mass or less, with respect to 100 parts by mass of the (meth)acrylic monomer.

A dispersant (surfactant) may be added into the dispersion medium where necessary. Examples of the dispersant are: a water soluble polymer such as polyvinyl alcohol and gelatin; an anionic surfactant such as sodium lauryl sulfate and sodium oleate; a cationic surfactant such as laurylamine acetate; a zwitterionic surfactant such as lauryl dimethylamine oxide and; a nonionic surfactant such as polyoxyethylene alkyl ether. When water is used as a dispersion medium and a free radical initiator is used as a polymerization initiator, it is preferable to use an anionic surfactant, more preferably sodium lauryl sulfate, as the dispersant.

The dispersant is preferably added in an amount of 0.1 part by mass or more, more preferably 0.5 part by mass or more, and is preferably added in an amount of 20 parts by mass or less, more preferably 10 parts by mass or less, with respect to 100 parts by mass of the produced (meth)acrylic polymer.

The reactor for the polymerization (the modification reaction of the silicate) of the monomer composition containing the (meth)acrylic monomer is not limited, but is preferably a stirring tank type which is provided with a stirring means that sufficiently disperses the unmodified silicate into the dispersion medium, a heating means, a temperature controlling means, a raw material supplying means (such as dripping means). Examples of the stirring means are: stirring blades such as three blade retreat impeller type, oar shape type, paddle type, propeller type, turbine type; and blowers of gas such as air. In order to promote dispersion further, gas blowing or application of ultrasound may be used together with mechanical mixing with stirring blades.

As specific examples of the method for manufacturing the (meth)acrylic polymer-modified silicate when using water as the dispersion medium, (1) a method without the use of dispersants and (2) a method with the use of dispersants are explained in the following.

First, (1) a method without the use of the dispersant is explained. Water (as the dispersion medium) and the unmodified silicate are put into the reactor, and the unmodified silicate is sufficiently dispersed by stirring. A temperature of the dispersion medium during dispersing the unmodified silicate is preferably 10° C. or more, and more preferably 20° C. or more, and is preferably 90° C. or less, and is more preferably 80° C. or less. Furthermore, a stirring time for dispersing the unmodified silicate is preferably 0.1 hour or more, more preferably 0.2 hour or more, and even more preferably 0.5 hour or more, and is preferably 20 hours or less, more preferably 15 hours or less, and even more preferably 10 hours or less. The stirring is done just by mechanical stirring or by mechanical stirring in combination with application of ultrasound or the like.

Next, after a dispersion liquid containing the unmodified silicate dispersed therein is cooled down to a room temperature, the polymerization initiator is added and the dispersion liquid is stirred and dispersed homogenously for about 1 hour.

Next, the polymerization is initiated by adding the monomer composition into the dispersion liquid where the unmodified silicate and the polymerization initiator are dispersed. In this method without the use of the dispersant, when a layered silicate is used as the unmodified silicate, a (meth)acrylic acid ester having a tertiary amino group is preferably used as the (meth)acrylic monomer. It is possible to intercalate the (meth) acrylic acid ester having the tertiary amino group in the interlayer of the layered silicate by the effect of the tertiary amino group and thus the layered silicate is broken up into a single-leaf state when polymerizing the monomer composition.

A polymerization temperature of the monomer composition is preferably 20° C. or more, more preferably 30° C. or more, and is preferably 90° C. or less, more preferably 80° C. or less. Furthermore, a polymerization time of the monomer composition is preferably 3 hours or more, more preferably 6 hours or more, even more preferably 8 hours or more, and is preferably 60 hours or less, more preferably 48 hours or less, and even more preferably 24 hours or less.

The (meth)acrylic polymer-modified silicate is precipitated by adding a precipitation medium (e.g. methanol) to a reaction liquid after the reaction time has elapsed, in an amount of 2 times to 5 times as much as the amount of the reaction liquid. A precipitate is removed by filtration or by centrifugation, and washed with methanol or the like, and vacuum dried for 12 hours or more at 50° C. to obtain the (meth)acrylic polymer-modified silicate.

Next, (2) a method with the use of the dispersant is explained. Water (as the dispersion medium), the unmodified silicate and the dispersant are put into the reactor, and the unmodified silicate is sufficiently dispersed by stirring. Conditions during dispersion such as the temperature of the dispersion medium, the stirring method and the stirring time, are all similar to the previously described (1) method without the use of the dispersants. Additionally, a part or all of the monomer composition may be added during the dispersion of the unmodified silicate.

In this method that uses a dispersant, when a layered silicate is used as the unmodified silicate, the stirring time is preferably 2 hours or more. Mixing and stirring the unmodified silicate and the dispersant sufficiently, make it possible for the dispersant to intercalate the interlayer of the layered silicate, thereby breaking up the layered silicate into a single-leaf sate. It is preferable that ultrasound is also applied in order to break up the layered silicate into a single-leaf state. An ultrasonic application time is preferably 0.5 hour or more, and more preferably 1 hour or more.

Next, the monomer composition is added into a dispersion liquid where the unmodified silicate and the dispersant are dispersed. Herein, when a part or all of the monomer composition is added during the dispersion of the unmodified silicate, the remainder of the monomer composition is added into the dispersion liquid. A stirring time for dispersing the monomer composition is preferably 0.1 hour or more, and more preferably 0.2 hour or more, and even more preferably 0.5 hour or more, and is preferably 20 hours or less, more preferably 15 hours or less, and even more preferably 10 hours or less. The stirring is done by only mechanical stirring or by mechanical stirring in combination with application of ultrasound or the like.

As described above, if the monomer composition is added to the dispersion liquid where the unmodified silicate is dispersed, and is stirred until the dispersion liquid becomes homogenous, a dispersant micelle which incorporates the unmodified silicate and the monomer composition and an oil droplet of the monomer composition are formed.

Next, the polymerization is initiated by adding the polymerization initiator to the dispersion liquid where the unmodified silicate, the dispersant and the monomer composition are dispersed. Polymerization starts when the polymerization initiator penetrates into the dispersant micelle. The polymerization goes on to form a (meth)acrylic polymer while the monomer component is supplied to the dispersant micelle from the oil droplet little by little. As a result, the (meth)acrylic polymer-modified silicate where the silicate is dispersed into the (meth)acrylic polymer is manufactured.

The polymerization temperature and polymerization time of the monomer composition, and the method to remove the (meth)acrylic polymer-modified silicate from the reaction liquid after the reaction, are both similar to those in (1) the method without the use of the dispersants.

The (meth)acrylic polymer constituting the (meth)acrylic polymer-modified silicate, without limitation, preferably has the number average molecular weight of 10,000 or more, more preferably 30,000 or more, and even more preferably 50,000 or more, and preferably has the number average molecular weight of 300,000 or less, more preferably 250,000 or less, and even more preferably 200,000 or less. If the number average molecular weight of the (meth)acrylic polymer is less than 10,000, the mechanical properties of the (meth)acrylic polymer become inferior, which may possibly lead to deterioration of mechanical properties of the cover. On the other hand, if the number average molecular weight of the (meth)acrylic polymer is more than 300,000, the compatibility between the (meth)acrylic polymer and the resin component used as a cover composition is lowered, and thus the dispersibility of the (meth)acrylic polymer-modified silicate may become insufficient. The number average molecular weight of the (meth)acrylic polymer is measured by using gel permeation chromatography (GPC), with the use of; polystyrene as a standard material, tetrahydrofuran as an eluting solution, and two of TSK-GEL SUPERH2500 columns (available from Tosoh Co., Ltd.).

A content of the silicate in the (meth)acrylic polymer-modified silicate is preferably 1 mass % or more, more preferably 2 mass % or more, and even more preferably 5 mass % or more, and is preferably 40 mass % or less, more preferably 30 mass % or less, and even more preferably 20 mass % or less. If the content of the silicate in the (meth)acrylic polymer-modified silicate is less than 1 mass %, the improved abrasion-resistance and repulsion by the (meth)acrylic polymer-modified silicate may not be obtained. On the other hand, if the content of the silicate in the (meth)acrylic polymer-modified silicate is more than 40 mass %, the silicate in the (meth) acrylic polymer-modified silicate tends to aggregate. The content of silicate in the (meth)acrylic polymer-modified silicate may be measured by thermogravimetric analysis.

A resin component used in the present invention is explained in the following.

The resin component is not limited, examples of the resin component are a thermoplastic polyurethane, an ionomer resin, a thermoplastic polyamide elastomer, a thermoplastic polyester elastomer, a thermoplastic polystyrene elastomer, and the combination thereof.

The thermoplastic polyurethane used in the present invention is not particularly limited, as long as it has a plurality of urethane bonds in a molecule and exhibits thermoplasticity. For example, the thermoplastic polyurethane is a reaction product obtained by reacting a polyisocyanate component with a polyol component to form urethane bonds in a molecule thereof, where necessary, obtained by further carrying out a chain extension reaction with a chain extender such as a low-molecular weight polyol and a low-molecular weight polyamine.

The polyisocyanate component, which constitutes the thermoplastic polyurethane, is not limited as long as it has at least two isocyanate groups. Examples of the polyisocyanate include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene-diisocyanate (TMXDI), para-phenylene diisocyanate (PPDI); an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used either alone or as a mixture of at least two of them.

In view of improving the abrasion-resistance, the aromatic polyisocyanate is preferably used as the polyisocyanate component of the thermoplastic polyurethane. A use of the aromatic polyisocyanate improves the mechanical property of the obtained polyurethane and provides the cover with the excellent abrasion-resistance. In addition, in view of improving the weather resistance, as the polyisocyanate component of the thermoplastic polyurethane, a non-yellowing type polyisocyanate such as TMXDI, XDI, HDI, $H_6$XDI, IPDI, $H_{12}$MDI and NBDI is preferably used. More preferably, 4,4'-dicyclohexylmethane diisocyanate ($H_{12}$MDI) is used. Since 4,4'-dicyclohexylmethane diisocyanate ($H_{12}$MDI) has a rigid structure, the mechanical property of the resulting polyurethane is improved, and thus the cover which is excellent in abrasion-resistance can be obtained.

The polyol component constituting the thermoplastic polyurethane is not particularly limited as long as it has a plurality of hydroxyl groups, and such examples include a low-molecular weight polyol and a high-molecular weight polyol. Examples of the low-molecular weight polyol may include a diol such as ethylene glycol, diethylene glycol, triethylene glycol, propanediol, dipropyleneglycol, 1,3-butanediol, 1,4-butanediol, neopentyl glycol, 1,6-hexanediol; a triol such as glycerin, trimethylol propane, and hexanetriol. Examples of the high-molecular weight polyol include a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ε-caprolactone (PCL); a polycarbonate polyol such as polyhexamethylene carbonate; and an acrylic polyol. The above polyols may be used alone or as a mixture of at least two of them.

A number average molecular weight of the high-molecular weight polyol is not particularly limited, and for example, it is preferably 400 or more, more preferably 1,000 or more. If the number average molecular weight of the high-molecular weight polyol is made 400 or more, the resultant polyurethane does not become too hard and the shot feeling of the golf ball is improved. The upper limit of the number average molecular weight of the high molecular weight polyol is not particularly limited, and it is preferably 10,000, more preferably 8,000. The number average molecular weight of the polyol component can be measured by Gel permeation Chromatography using two columns of TSK-GEL SUPREH 2500 (TOSOH Corporation) as a column, polystyrene as a standard material, and tetrahydrofuran as an eluate.

The polyamine component that constitutes the thermoplastic polyurethane where necessary may include any polyamine, as long as it has at least two amino groups. The polyamine includes an aliphatic polyamine such as ethylenediamine, propylenediamine, butylenediamine, and hexamethylenediamine, an alicyclic polyamine such as isophoronediamine, piperazine, and an aromatic polyamine.

The aromatic polyamine has no limitation as long as it has at least two amino groups directly or indirectly bonded to an aromatic ring. Herein, the "indirectly bonded to the aromatic ring", for example, means that the amino group is bonded to the aromatic ring via a lower alkylene bond. Further, the aromatic polyamine includes, for example, a monocyclic aromatic polyamine having at least two amino groups bonded to one aromatic ring or a polycyclic aromatic polyamine having at least two aminophenyl groups each having at least one amino group bonded to one aromatic ring.

Examples of the monocyclic aromatic polyamine include a type such as phenylenediamine, tolylenediamine, diethyltoluenediamine, and dimethylthiotoluenediamine wherein amino groups are directly bonded to an aromatic ring; and a type such as xylylenediamine wherein amino groups are bonded to an aromatic ring via a lower alkylene group. Further, the polycyclic aromatic polyamine may include a poly (aminobenzene) having at least two aminophenyl groups directly bonded to each other or a compound having at least two aminophenyl groups bonded via a lower alkylene group or an alkylene oxide group. Among them, a diaminodiphenylalkane having two aminophenyl groups bonded to each other via a lower alkylene group is preferable. Typically preferred are 4,4'-diaminodiphenylmethane or the derivatives thereof.

The thermoplastic polyurethane has no limitation on the constitutional embodiments thereof. Examples of the constitutional embodiments are the embodiment where the polyurethane consists of the polyisocyanate component and the high-molecular weight polyol component; the embodiment where the polyurethane consists of the polyisocyanate component, the high-molecular weight polyol component and the low-molecular weight polyol component; and the embodiment where the polyurethane consists of the polyisocyanate component, the high-molecular weight polyol component, the low-molecular weight polyol component, and the polyamine component; and the embodiment where the polyurethane consists of the polyisocyanate component, the high-molecular weight polyol component and the polyamine component.

A slab hardness of the thermoplastic polyurethane used as the resin component is preferably 75 or more, and more preferably 80 or more, and is preferably 98 or less, more preferably 95 or less, and even more preferably 90 or less in Shore A hardness. Having the slab hardness of the thermoplastic polyurethane to be 75 or more in Shore A hardness, allows the cover composition not to be too soft, which provides excellent resilience. On the other hand, having the slab hardness of the thermoplastic polyurethane to be 98 or less in Shore A hardness, allows the cover composition not to be too hard, which provides sufficient durability.

Specific examples of the thermoplastic polyurethane are "Elastollan (registered trademark) XNY85A", "Elastollan (registered trademark) XNY80A", "Elastollan (registered trademark) XNY90A" and "Elastollan (registered trademark) XNY97A", all available from BASF JAPAN Co., Ltd.

Examples of the ionomer resin include one prepared by neutralizing at least a part of carboxyl groups in a copolymer composed of ethylene and α,β-unsaturated carboxylic acid with a metal ion; one prepared by neutralizing at least a part of carboxyl groups in a terpolymer composed of ethylene, α,β-unsaturated carboxylic acid, and α,β-unsaturated carboxylic acid ester with a metal ion; and a mixture of these two. Examples of the α,β-unsaturated carboxylic acid include acrylic acid, methacrylic acid, fumaric acid, maleic acid, crotonic acid, or the like. In particular, acrylic acid and methacrylic acid are preferable. Examples of the α,β-unsaturated carboxylic acid ester include methyl ester, ethyl ester, propyl ester, n-butyl ester, isobutyl ester of acrylic acid, methacrylic acid, fumaric acid, and maleic acid. In particular, acrylic acid ester and methacrylic acid ester are preferable. Examples of the metal ion for neutralizing at least a part of the carboxyl groups in the copolymer composed of ethylene and the α,β-unsaturated carboxylic acid or in the terpolymer composed of ethylene, the α,β-unsaturated carboxylic acid, and the α,β-unsaturated carboxylic acid ester are; monovalent metal ions such as sodium, potassium, and lithium; divalent metal ions such as magnesium, calcium, zinc, barium, and cadmium; trivalent metal ions such as aluminum, or other metal ions such as tin and zirconium. In particular, sodium ion, zinc ion, and magnesium ion are preferably used in view of the resilience and durability of the golf ball.

Specific examples of the ionomer resin include "Himilan (registered trade mark) 1555, 1557, 1605, 1652, 1702, 1705, 1706, 1707, 1855, 1856" available from MITSUI-DUPONT POLYCHEMICAL CO., LTD, "Surlyn (registered trade mark) 8945, 9945, 6320" available from DUPONT CO, and "Iotek (registered trade mark) 7010, 8000" available from Exxon Co. These ionomer resins may be used individually or as a combination of two or more thereof.

Specific examples of the thermoplastic elastomer includes a thermoplastic polyamide elastomer having a commercial name of "PEBAX 2533", available from ARKEMA Inc; a thermoplastic polyester elastomer having a commercial name of "HYTREL 3548" and "HYTREL 4047" available from DU PONT-TORAY Co and "Primalloy (registered trademark) A1500" available from Mitsubishi Chemical Co.; and a thermoplastic polystyrene elastomer having a commercial name of "Rabalon" available from Mitsubishi Chemical Co.

The thermoplastic polystyrene elastomer includes, for example, a polystyrene-diene block copolymer comprising a polystyrene block component as a hard segment and a diene block component, for example polybutadiene, isoprene, hydrogenated polybutadiene, hydrogenated polyisoprene, as a soft segment. The polystyrene-diene block copolymer comprises a double bond derived from a conjugated diene compound of block copolymer or hydrogenated block copolymer. Examples of the polystyrene-diene block copolymer are a block copolymer having a SBS (styrene-butadiene-styrene) comprising polybutadiene block; and a block copolymer having a SIS (styrene-isoprene-styrene) structure.

The resin component preferably contains a thermoplastic polyurethane and/or an ionomer resin as a main component. The resin component preferably contains the polyurethane and/or the ionomer resin in an amount of 50 mass % or higher, more preferably 70 mass % or higher, and even more preferably 90 mass % or higher. Further, it is also preferable that the resin component essentially consists of the polyurethane and/or the ionomer resin.

The cover composition used in the golf ball of the present invention may further contain a pigment component such as titanium oxide and a blue pigment, a specific gravity adjusting agent such as calcium carbonate and barium sulfate, a dispersant, an antioxidant, an ultraviolet absorber, a light stabilizer, a fluorescent material or a fluorescent brightener, in addition to the resin component and the (meth)acrylic polymer-modified silicate, to the extent that the cover performance is not damaged.

The content of the white pigment (titanium oxide) is preferably 0.5 part by mass or more, more preferably 1 part by mass or more, and is preferably 10 parts by mass or less, more preferably 8 parts by mass or less based on 100 parts by mass of the resin component constituting the cover. The white pigment in an amount of 0.5 part by mass or more can impart opacity to the cover, while the white pigment in an amount of more than 10 parts by mass may lower the durability of the resulting cover.

The cover of the golf ball in the present invention is manufactured by molding the cover composition obtained by kneading the (meth)acrylic polymer-modified silicate, the resin component and various additives. A known kneading method may be used for kneading the cover composition. For example, if kneading is done with a twin-screw extruder, it is preferred that the following conditions are met: screw L/D of 15 to 60, usage of a full-flight screw with a screw diameter of 1 cm to 10 cm, screw revolutions of 50 rpm to 3,000 rpm, kneading temperature of 140° C. to 220° C.

A slab hardness of the cover composition is preferably 75 or more, more preferably 78 or more, and even more preferably 80 or more, and is preferably 98 or less, more preferably 95 or less, and even more preferably 90 or less in Shore A hardness. If the slab hardness of the cover composition is less than 75 in Shore A hardness, the cover composition becomes too soft and it may get stuck or get blocked in a mold, which reduces productivity. If the slab hardness of the cover composition is more than 98 in Shore A hardness, the cover composition becomes too hard and it may result in the reduction of the abrasion-resistance of the cover.

An embodiment for molding a cover using the cover composition is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding). When forming the cover by injection molding the cover composition directly onto the core, it is preferable to use upper and lower molds for forming the cover having a spherical cavity and pimples, wherein a part of the pimple also serves as a retractable hold pin. When forming the cover by injection molding, the hold pin is protruded to hold the core, and the cover composition which has been heated is charged and then cooled to obtain a cover. For example, the cover composition heated at the temperature of 200° C. to 250° C. is charged into a mold held under the pressure of 9 MPa to 15 MPa for 0.5 to 5 second. After cooling for 10 to 60 seconds, the mold is opened and the golf ball with the cover molded is taken out from the mold.

A cover thickness of the golf ball in the present invention is preferably 0.2 mm or more, more preferably 0.3 mm or more, and is preferably 2.0 mm or less, more preferably 1.8 mm or less, and even more preferably 1.5 mm or less. By having the cover thickness of 0.2 mm or more, the positive effect of the present invention can be obtained and the durability improves, and on the other hand, by having the cover thickness of 2.0 mm or less, the sufficient resilience is obtained.

When molding a cover, the concave portions called "dimple" are usually formed on the surface. After the cover is molded, the mold is opened and the golf ball body is taken out from the mold, and as necessary, the golf ball body is preferably subjected to surface treatment such as deburring, cleaning, and sandblast. If desired, a paint film or a mark may be formed. The paint film preferably has a thickness of, but not limited to, 5 μm or larger, and more preferably 7 μm or larger, and preferably has a thickness of 25 μm or smaller, and more preferably 18 μm or smaller. This is because if the thickness is smaller than 5 μm, the paint film is easy to wear off due to continued use of the golf ball, and if the thickness is larger than 25 μm, the effect of the dimples is reduced, resulting in deteriorating flying performance of the golf ball.

Next, the preferable embodiment of the core of the golf ball of the present invention will be explained.

The core of the golf ball of the present invention includes a single layered core, a core consisting of a center and a single-layered intermediate layer covering the center, a core consisting of a center and multi-piece or multi-layer of intermediate layers covering the center. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs. For example, the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east (west), assuming that the meridian as the standard is at longitude 0 degrees. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

As the core or the center of the golf ball of the present invention, a conventionally known rubber composition (hereinafter simply referred to as "core rubber composition" occasionally) may be employed, and it can be molded by, for example, heat-pressing a rubber composition containing a base rubber, a crosslinking initiator, a co-crosslinking agent, and a filler.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4 bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.2 part by mass or more, more preferably 0.3 part by mass or more, and is preferably 3 parts by mass or less, more preferably 2 parts by mass or less based on 100 parts by mass of the base rubber. If the amount is less than 0.2 part by mass, the core becomes too soft, and the resilience tends to be lowered, and if the amount is more than 3 parts by mass, the core becomes too hard, and the shot feeling may be lowered.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience. The amount of the co-crosslinking agent to be used is preferably 10 parts or more, more preferably 20 parts or more, and is preferably 50 parts or less, more preferably 40 parts or less based on 100 parts of the base rubber by mass. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 50 parts by mass, the core becomes too hard, so that the shot feeling may be lowered.

The filler contained in the core rubber composition is mainly blended as a specific gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts or more, more preferably 3 parts or more, and preferably 50 parts or less, more preferably 35 parts or less based on 100 parts of the base rubber by mass. If the amount of the filler to be blended is less than 2 parts by mass, it becomes difficult to adjust the weight, while if it is more than 50 parts by mass, the weight ratio of the rubber component becomes small and the resilience tends to be lowered.

As the core rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; a di-substituted diphenyl disulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; a tri-substituted diphenyl disulfide such as bis(2,4,6-trichlorophenyl)disulfide, and bis(2-cyano-4-chloro-6-bromophenyl)disulfide; a tetra-substituted diphenyl disulfide such as bis(2,3,5,6-tetra chlorophenyl)disulfide; a penta-substituted diphenyl disulfide such as bis(2,3,4,5,6-pentachlorophenyl)disulfide and bis(2,3,4,5,6-pentabromophenyl)disulfide. These diphenyl disulfides or the derivative thereof can enhance resilience by having some influence on the state of vulcanization of vulcanized rubber. Among them, diphenyl disulfide and bis(pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

The conditions for press-molding the core rubber composition should be determined depending on the rubber composition. The press-molding is preferably carried out for 10 to 60 minutes at the temperature of 130° C. to 200° C. Alternatively, the press-molding is preferably carried out in a two-step heating, for example, for 20 to 40 minutes at the temperature of 130° C. to 150° C., and continuously for 5 to 15 minutes at the temperature of 160° C. to 180° C.

The core preferably has a diameter of 39.0 mm or larger, more preferably 39.5 mm or larger, even more preferably 40.8 mm or large. If the diameter of the core is smaller than 39.0 mm, the thickness of the cover needs to be thicker than a desired thickness, resulting in the reduction of the golf ball's resilience. The upper limit of the diameter of the core is preferably, without limitation, 42.2 mm, more preferably 42.0 mm, even more preferably 41.8 mm. If the diameter of the core is larger than 42.2 mm, the thickness of the cover needs to be relatively thinner, and the protection effect of the cover may not be obtained.

A compression deformation amount (shrinking deformation amount of the core along the compression direction) of the core when applying a load from 98 N as an initial load to 1275 N as a final load is preferably 2.50 mm or more, more preferably 2.60 mm or more, even more preferably 2.70 mm or more, and is preferably 3.20 mm or less, more preferably 3.10 mm or less, even more preferably 3.00 mm or less. If the compression deformation amount is within the above range, the excellent shot feeling is provided.

It is preferable that the core of the present invention has a larger surface hardness than the center hardness. For example, if the core consists of multiple layers, it is easy to make the surface hardness of the outermost layer larger than the center hardness. The hardness difference between the surface and the center of the core in the golf ball of the present invention is preferably 20 or larger, more preferably 25 or larger in Shore D hardness. Making the surface hardness of the core larger than the center hardness increases the launch angle and decreases the amount of spin, thereby improving the flight distance of the golf ball. The upper limit of the hardness difference between the surface and the center of the core is, without limitation, preferably 40, more preferably 35 in Shore D. If the hardness difference is larger than the above upper limit, the durability of the golf ball tends to be lower.

The center hardness of the core is preferably 30 or larger, more preferably 32 or larger, and even more preferably 35 or larger in Shore D hardness. If the center hardness is smaller than 30 in Shore D hardness, the core becomes so soft that the resilience of the golf ball tends to be lower. The center hardness of the core is preferably 50 or smaller, more preferably 48 or smaller, and even more preferably 45 or smaller in Shore D. If the center hardness is larger than 50 in Shore D hardness, the core becomes so hard that the shot feeling deteriorates. In the present invention, the center hardness of the core is the hardness measured with the Shore D type spring hardness tester at the central point of a cut plane of a core which has been cut into two halves.

The surface hardness of the core is preferably 45 or larger, more preferably 50 or larger, and even more preferably 55 or larger in Shore D hardness. If the surface hardness is smaller than 45, the core becomes so soft and the resilience may be lowered. The surface hardness of the core is preferably 65 or smaller, more preferably 62 or smaller, and even more preferably 60 or smaller in shore D hardness. If the surface hardness is larger than 65 in Shore D hardness, the core becomes so hard that the shot feeling may deteriorate.

The core in the golf ball of the present invention preferably has a PGA compression of 65 or more, more preferably 70 or more. The resilience reduces if the PGA compression of the core is below 65. This also makes the shot feeling too heavy because the core is too soft. The upper limit of the PGA compression of the core is not particularly limited, but is preferably 115, more preferably 110. If the PGA compression of the core exceeds 115, the core becomes too hard and the shot feeling deteriorates.

Examples of the material that constitutes the intermediate layer are: thermoplastic resins such as a polyurethane resin, an ionomer resin, nylon and polyethylene; and thermoplastic elastomers such as a polystyrene elastomer, a polyolefin elastomer, a polyurethane elastomer and a polyester elastomer. Among these, the ionomer resin is preferred.

Examples of the ionomer resin include an ionomer resin prepared by neutralizing at least a part of carboxyl groups in a copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof.

Examples of the α,β-unsaturated carboxylic acids are; acrylic acid, methacrylic acid, fumaric acid, maleic acid and crotonic acid. Among these, acrylic acid and methacrylic acid are particularly preferred. Examples of the α,β-unsaturated carboxylic acid ester include methyl ester, ethyl ester, propyl ester, n-butyl ester, isobutyl ester of acrylic acid, methacrylic acid, fumaric acid, and maleic acid. In particular, acrylic acid ester and methacrylic acid ester are preferable. Examples of the metal ion for neutralizing at least a part of the carboxyl groups in the copolymer composed of ethylene and the α,β-unsaturated carboxylic acid or in the terpolymer composed of ethylene, the α,β-unsaturated carboxylic acid, and the α,β-unsaturated carboxylic acid ester are; monovalent metal ions such as sodium, potassium, and lithium; divalent metal ions such as magnesium, calcium, zinc, barium, and cadmium; trivalent metal ions such as aluminum, or other metal ions such as tin and zirconium. In particular, sodium ion, zinc ion, and magnesium ion are preferably used in view of the resilience and durability of the golf ball.

The intermediate layer of the golf ball of the present invention may contain a specific gravity adjustment agent such as barium sulfate and tungsten, an anti-oxidant, and a pigment in addition to the above resin component.

The golf ball of the present invention is not particularly limited on a structure thereof as long as the golf ball has a core and a cover. Examples of the golf ball of the present invention include a two-piece golf ball comprising a single-layered core, and a cover covering the core; a three-piece golf ball comprising a core consisting of a center and an intermediate layer covering the center, and a cover covering the core; a multi-piece golf ball comprising a core consisting of a center and a multi-piece or multi-layer of intermediate layers covering the center, and a cover covering the core; and a wound golf ball comprising a wound core, and a cover covering the wound core. The present invention can be suitably applied to anyone of the above golf ball. Among them, the present invention can be preferably applied to the two-piece golf ball including a single-layered core, and a cover covering the core.

When preparing a wound golf ball in the present invention, a wound core may be used as the core. In that case, for example, a wound core comprising a center formed by curing the above rubber composition for the core and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of a natural rubber and a synthetic polyisoprene, a sulfur, a vulcanization auxiliary agent, a vulcanization accelerator, and an antioxidant. The rubber thread is wound around the center in elongation of about 10 times length to form the wound core.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Method]

(1) Thermogravimetric Analysis

Thermogravimetric analysis was conducted with a Differential Thermogravimetric Analyzer (Thermo plus TG8120 from Rigaku Co.) under an air flow (flow rate 200 ml/min), in a temperature range of 30° C. to 900° C., with a temperature raising speed of 10° C./min.

(2) Measurement of X-Ray Diffraction

Measurement of X-ray diffraction was conducted with an X-ray diffractometer (RINT2200 V-TYPE from Rigaku Co.) and interlayer distance of layered silicates of an unmodified layered silicate and the (meth)acrylic polymer-modified silicate were measured.

X-ray source: CuKα radiation (wavelength $\lambda$=0.15418 nm)

Applied voltage: 40 kV

Applied current: 30 mA

Measured ranged: $2\theta$=0.01° to 10°

Measured interval: 0.01°

Calculation formula: $2\ d \sin\theta=\lambda=0.15418$ nm ($\theta$: ½ of the peak angle ($2\theta$))

(3) Slab Hardness (Shore A Hardness)

Using the cover composition, a sheet having a thickness of about 2 mm were prepared by hot press molding and preserved at the temperature of 23° C. for two weeks. Three or more of the sheets were stacked on one another to avoid being affected by the measuring substrate on which the sheets were placed, and the stack was subjected to the measurement using P1 type auto hardness tester provided with the Shore A type spring hardness tester prescribed by ASTM-D2240, available from KOUBUNSHI KEIKI CO., LTD to obtain the respective slab hardness of the cover composition.

(4) Core Hardness (Shore D Hardness)

The shore D hardness measured at a surface part of a spherical core using P1-type automatic rubber hardness tester equipped with the Shore D type spring hardness tester specified by ASTM-D2240 manufactured by Kobunshi Keiki Co., Ltd., was determined as the surface hardness of the spherical core, and the shore D hardness obtained by cutting the spherical core into halves and measuring at a center of the cut surface was determined as the center hardness of the spherical core.

(5) PGA Compression

Measurement was carried out using a compression measurement apparatus manufactured by OMI WEIGHING MACHINE INC.

(6) Repulsion Coefficient of Golf Balls

Aluminum cylinder having a weight of 200 g was collided with the resultant golf balls at the speed of 40 m/sec. to measure the speed of the cylinder and the golf ball before and after the collision. The repulsion coefficient of each golf ball was obtained based on each of the measured speed and weight. Each golf ball was measured 12 times to obtain the average. The repulsion coefficient measured in terms of each golf ball is reduced to an index number relative to the measured value obtained in Golf ball No. 10 whose repulsion coefficient is assumed 100.

(7) Abrasion-Resistance

A commercially available pitching wedge was installed on a swing robot available from Golf Laboratories, Inc., and two points of a ball respectively were hit once at the head speed of 36 m/sec. to observe the areas which were hit. Abrasion-resistance was evaluated and ranked into four levels based on following criteria.

E(Excellent): Almost no scratch was present on the surface of the golf ball.

G(Good): Slight scratches were present on the surface of the golf ball, but were not conspicuous.

F(Fair): Scratches were conspicuous, and scuffing could be observed.

P(Poor): The surface of the golf ball was abraded considerably, and scuffing was conspicuous.

[Manufacturing (meth)acrylic Polymer-Modified Silicate]

Manufacturing Example 1

3.60 g of montmorillonite ("Kunipia (registered trademark) F" from Kunimine Industries Co., Ltd., with a cation exchange capacity of 115 mEq/100 g) as a layered silicate, and 350 ml of distilled water as a dispersion medium, were put into a 4-necked 1000 ml reaction flask that was provided with a stirring device, a heating device, a reflux apparatus and a liquid dripping device. Montmorillonite was dispersed uniformly by applying ultrasound for 12 hours at 80° C. After being cooled down to a room temperature, 0.35 g of potassium peroxydisulfate was added as a polymerization initiator, and dispersed uniformly again by stirring for 1 hour at a room temperature.

As a methacrylic monomer to form a methacrylate polymer for modification, 32.20 g of methyl methacrylate and 1.05 g of (meth)acrylic acid 2-(dimethylamino)ethyl were added to the dispersion liquid, and the polymerization reaction was carried out for 12 hours at 60° C. The reaction liquid was transferred to a 2000 ml beaker, and a (meth)acrylic polymer-modified compound was precipitated by adding 1000 ml of methanol. The precipitate was filtered out, and washed with 500 ml of methanol, and vacuum dried at 70° C. for 48 hours to obtain 34.66 g of the (meth)acrylic polymer-modified layered silicate (hereinafter sometimes referred to as "MtSF").

Results from the thermogravimetric analysis showed that the amount of the inorganic material contained in the MtSF is 11.5 mass %. Measurement of X-ray diffraction was conducted in order to see how the interlayer distance within the montmorillonite changed by this polymer modification. This result is shown in FIG. 1. As shown in FIG. 1, the diffraction line observed in the montmorillonite (Mt) prior to modification is not observed in the MtSF. From this observation, it is assumed that each layer of the montmorillonite is separated and become single-leaf state by the (meth)acrylic polymer modification. The sample represented as PMMA in FIG. 1 shows a homopolymer of polymethylmethacrylate.

Manufacturing Example 2

4.77 g of porous silica (product name "NPM-14" (pore diameter 1-10 nm) from Taiyo Kagaku Co., Ltd.) as a porous silicate and 43.0 g of methyl methacrylate as a (meth)acrylic monomer to form a methacrylate polymer for modification, were added to a 100 ml beaker. The porous silica was dispersed uniformly by applying ultrasound for 30 minutes to obtain a methyl methacrylate dispersion of the porous silica.

400 ml of 0.5 mass % solution of sodium lauryl sulfate as a dispersion medium containing a dispersant was put into a 4-necked 1000 ml reaction flask that was provided with a stirring device, a heating device, a reflux apparatus and a liquid dripping device. Into this solution, the whole amount of the previously prepared methyl methacrylate dispersion of the porous silica was added. The content in the flask was dispersed uniformly by applying ultrasound for 30 minutes at 60° C.

Polymerization reaction was carried out, by dripping in, during a course of 2 hours, an initiator solution made from 0.48 g of potassium peroxydisulfate dissolved in 100 ml of distilled water as a polymerization initiator, while stirring the content in the flask for a total of 12 hours at 60° C.

The reaction liquid was transferred to a 2000 ml beaker, and a (meth)acrylic polymer-modified compound was precipitated by adding 1000 ml of methanol. The precipitate was filtered out, and washed with 500 ml of methanol, and vacuum dried at 50° C. for 48 hours, to obtain 30.68 g of the (meth)acrylic polymer-modified porous silicate (hereinafter sometimes referred to as NsEM).

Results from the thermogravimetric analysis showed that the amount of the inorganic material contained in the NsEM is 0.12 mass %.

[Manufacturing Organically Modified Silicate]

1 liter of distilled water was heated up to 80° C. and 20 g of montmorillonite ("Kunipia (registered trademark) F" from Kunimine Industries Co., Ltd., with a cation exchange capacity of 115 mEq/100 g) was added and dispersed. 7.44 g of Stearylamine (available from Tokyo Chemical Industry Co.) and 2.5 ml of concentrated hydrochloric acid (concentration: 12 mol/1) were added to the montmorillonite dispersed solution, and stirred for 1 hour. After stirring, the organically modified montmorillonite was filtered out, and washed with water and a methanol solution (water/methanol=1/1). Next, by thoroughly removing water, an organic silicate was obtained.

Measuring the obtained organic silicate with X-ray diffraction revealed that, while the montmorillonite prior to organic modification has an interlayer distance of 1 nm, the montmorillonite after organic modification has a wider interlayer distance of 2 nm.

[Manufacturing a Golf Ball]

(1) Manufacturing a Core

The core rubber compositions having formulations shown in Table 1 were kneaded and pressed in upper and lower molds, each having a hemispherical cavity, at a temperature of 160° C. for 13 minutes to obtain a spherical core having a diameter of 40.7 mm.

TABLE 1

| Core rubber composition | | |
|---|---|---|
| Formulation | Polybutadiene rubber | 100 |
| | Zinc acrylate | 35 |
| | Zinc oxide | 5.0 |
| | Barium sulfate | 14.0 |
| | Diphenyl disulfide | 0.5 |
| | Dicumyl peroxide | 0.9 |
| Core Property | Center hardness (Shore D hardness) | 40 |
| | Surface hardness (Shore D hardness) | 58 |

Formulation: parts by mass

Notes on table 1:

Polybutadiene rubber: "BR730 (high-cis polybutadiene (cis content percentage of 96% or more)" available from JSR Co.

Zinc oxide: "Ginrei R" from Toho-zinc Co., Ltd.

Zinc acrylate: "ZNDA-90S" from Nihon Jyoryu Kogyo Co., Ltd.

Barium sulfate: "Barium sulfate BD" from Sakai Chemical Industry Co., Ltd.

Diphenyl disulfide: From Sumitomo Seika Chemicals Co.

Dicumyl peroxide: "Percumyl (registered trademark) D" from NOF Co.

(2) Manufacturing a Cover Composition and a Golf Ball

Next, the cover materials shown in Table 2 were mixed by a twin-screw extruder ("2D25S" available from Toyo Seiki Seisaku-sho Ltd.) to prepare cover compositions in a form of the pellet. As the specification of the twin-screw extruder, a full flight screw (screw diameter=2 cm, screw L/D=25) was used with screw revolutions of 70 rpm. The mixture was heated so that the temperature at the die position of the extruder was 160 to 180° C. Continuously, the cover composition was directly injection molded onto the core to form a cover covering the core. Upper and lower molds for forming the cover each have a hemispherical cavity with pimples, and a part of the pimples serves as a hold pin which is extendable and retractable. The hold pins were protruded to hold the core, the resin heated to a temperature of 210° C. was charged into the mold under a pressure of 80 tons for 0.3 seconds, and cooled for 30 seconds. Then, the mold was opened, and the golf ball body was taken out therefrom. The surface of the obtained golf ball body was subjected to a sandblast treatment and marking, and then clear paint was applied thereto and dried in an oven at a temperature of 40° C. to obtain a golf ball having a diameter of 42.8 mm and a weight of 45.4 g.

Table 2 shows the evaluation results of the abrasion-resistance and the resilience of the obtained golf balls.

TABLE 2

| | | | | Golf ball No. | | | | | |
|---|---|---|---|---|---|---|---|---|---|
| | | | | 1 | 2 | 3 | 4 | 5 | 6 |
| Cover composition | Formulation | Resin component | XNY85A | 100 | 100 | 100 | 100 | 100 | 100 |
| | | | XNY75A | — | — | — | — | — | — |
| | | | XNY70A | — | — | — | — | — | — |
| | | (meth)acrylic polymer modified silicate | MtSF | 0.01 | 0.1 | 1.0 | 5.0 | 10.0 | 15.0 |
| | | | NsEM | — | — | — | — | — | — |
| | | Montmorillonite | | — | — | — | — | — | — |
| | | Organically modified silicate | | — | — | — | — | — | — |
| | | Titanium oxide | | 4 | 4 | 4 | 4 | 4 | 4 |
| | Property | Slab hardness (Shore A hardness) | | 85 | 85 | 86 | 89 | 91 | 98 |
| Golf ball property | | Repulsive Coefficient | | 100 | 100 | 101 | 103 | 106 | 110 |
| | | Abrasion-resistance | | G | E | E | E | G | F |

| | | | | Golf ball No. | | | | | |
|---|---|---|---|---|---|---|---|---|---|
| | | | | 7 | 8 | 9 | 10 | 11 | 12 |
| Cover composition | Formulation | Resin component | XNY85A | 100 | — | — | 100 | 100 | 100 |
| | | | XNY75A | — | 100 | — | — | — | — |
| | | | XNY70A | — | — | 100 | — | — | — |
| | | (meth)acrylic polymer modified silicate | MtSF | — | 1.0 | 1.0 | — | — | — |
| | | | NsEM | 1.0 | — | — | — | — | — |
| | | Montmorillonite | | — | — | — | — | 1.0 | — |
| | | Organically modified silicate | | — | — | — | — | — | 1.0 |
| | | Titanium oxide | | 4 | 4 | 4 | 4 | 4 | 4 |
| | Property | Slab hardness (Shore A hardness) | | 86 | 76 | 71 | 85 | 86 | 86 |
| Golf ball property | | Repulsive Coefficient | | 101 | 100 | 98 | 100 | 98 | 99 |
| | | Abrasion-resistance | | E | E | G | G | P | F |

Formulation: parts by mass

XNY85A: "Thermoplastic polyurethane (Shore A hardness 85)" from BASF CO.

XNY75A: "Thermoplastic polyurethane (Shore A hardness 75)" from BASF CO.

XNY70A: "Thermoplastic polyurethane (Shore A hardness 70)" from BASF CO.

MtSF: methacrylic polymer modified montmorillonite

NsEM: methacrylic polymer modified porous silica

Montmorillonite: "Kunipia (registered trademark) F" from Kunimine Industries Co., Ltd., with a cation exchange capacity of 115 mEq/100 g.

The golf balls No. 1 to 9 are the cases where the cover is formed from the cover composition that contains the (meth) acrylic polymer-modified silicate and the resin component. These Golf balls No. 1 to 9 are all superior in repulsion and abrasion-resistance to the golf ball No. 10 that does not contain the (meth)acrylic polymer-modified silicate. In the Golf ball No. 6, the abrasion-resistance was slightly inferior to others, due to the large amount of the (meth)acrylic polymer-modified silicate added. The repulsion of the Golf ball No. 9 is slightly inferior to the Golf balls No. 3, and No. 8 that have 1 part by mass of MtSF, because of using a thermoplastic polyurethane having a low hardness as a resin component.

The Golf ball No. 11 contains unmodified montmorillonite in the cover composition and the Golf ball No. 12 contains organically modified silicate in the cover composition, and both of these Golf balls have a lower repulsion and abrasion-resistance than those of Golf ball No. 10.

The present invention is useful as a golf ball with excellent abrasion-resistance and resilience. This application is based on Japanese Patent application No. 2008-21852 filed on Jan. 31, 2008, the contents of which are hereby incorporated by reference.

What is claimed is:

1. A golf ball comprising:

a core; and a cover covering the core, wherein the cover is formed of a cover composition containing a (meth)acrylic polymer-modified silicate and a resin component, wherein the (meth)acrylic polymer comprises a (meth) acrylic acid ester having a tertiary amino group as a component, wherein the (meth)acrylic polymer-modified silicate is a silicate having a layered structure enveloped by a (meth) acrylic polymer, and wherein the (meth)acrylic polymer-modified silicate, before being mixed with the resin component, comprises a layered silicate having an inter layer spacing of at least 6 nm measured by X-ray diffraction, or having an attributed X-ray diffraction peak that is not detected.

2. The golf ball according to claim 1, wherein the silicate having the layered structure is at least one selected from a smectite group consisting of montmorillonite, beidellite, nontronite, saponite, ferrous saponite, hectorite, sauconite and stevensite.

3. The golf ball according to claim 1, wherein the silicate having the layered structure is montmorillonite.

4. The golf ball according to claim 1, wherein the cover contains 0.01 part to 20 parts by mass of the (meth)acrylic polymer-modified silicate with respect to 100 parts by mass of the resin component.

5. The golf ball according to claim 1, wherein the resin component contains a thermoplastic polyurethane or an ionomer resin.

6. The golf ball according to claim 1, wherein the cover composition has a slab hardness of 75 to 98 in Shore A hardness.

* * * * *